United States Patent [19]

Petraitis et al.

[11] Patent Number: 4,880,495

[45] Date of Patent: Nov. 14, 1989

[54] REGENERATION OF COPPER ETCH BATH

[75] Inventors: Kestutis F. Petraitis, Cleveland; Walter W. Baldauf, Jr., Eastlake, both of Ohio

[73] Assignee: The Harshaw Chemical Company, Edison, N.J.

[21] Appl. No.: 37,477

[22] Filed: Apr. 13, 1987

[51] Int. Cl.[4] ..... C09K 13/06; C23F 1/00

[52] U.S. Cl. ..... 156/642; 156/666; 252/79.2; 252/79.4; 23/300; 23/305 R

[58] Field of Search ..... 252/79.5, 79.2, 79.4; 156/642, 666; 23/300, 305 R

[56] References Cited

U.S. PATENT DOCUMENTS

| | | | |
|---|---|---|---|
| 3,556,883 | 1/1971 | Naito et al. | 252/79.4 X |
| 3,773,557 | 11/1973 | Shibasaki et al. | 156/8 |
| 4,141,850 | 2/1979 | Readio et al. | 252/79.4 |

*Primary Examiner*—David L. Lacey
*Assistant Examiner*—Thi Dang

[57] ABSTRACT

This invention relates to a copper etching process which involves contacting the copper with an aqueous etching solution comprising sulfuric acid and a peroxide to which is added less than about 0.2% of an organic additive useful as a crystallization control agent and selected from the group consisting of a low molecular weight glycol and gum arabic. With this compound present, copper sulfate crystals do not adhere to the tank and removal of the crystals from the bath is facilitated.

7 Claims, No Drawings

REGENERATION OF COPPER ETCH BATH

BACKGROUND OF THE INVENTION

This invention relates to a method of using a copper etchant for the removal of copper from substrates such as printed circuit boards. In the production of such boards, conductive circuits are developed by forming a mask over a copper laminate using an etch resistant material such as plastic. The laminate is then exposed to a chemical which etches away the unprotected copper. A typical etchant is composed of hydrogen peroxide and sulfuric acid.

A substantial number of prior art patents have been issued covering various peroxide/sulfuric acid etchants containing numerous additives intended to promote or accentuate certain properties of the etching solution. For example, various organic corrosion inhibitors such as saturated aliphatic acids or esters, sulfonates or sulfonic acids are covered in U.S. Pat. No. 3,412,032. Catalysts such as urea or thiourea (U.S. Pat. No. 3,668,131) or thio sulfate (U.S. Pat. No. 4,130,455) or low molecular weight carboxylic acids (U.S. Pat. No. 4,462,861) are not used to promote etching rates. A number of compounds are mentioned as stabilizers including substituted aniline, sulfones and sulfolanes (U.S. Pat. No. 3,801,512), and oxy quinoline (U.S. Pat. No. 4,022,703).

U.S. Pat. No. 4,141,850 recommends the use of a glycol as a promoter to enhance the dissolution rate of the etching solution in the presence of chloride or bromide ions. However, it discourages the use of either ethylene glycol or propylene glycol for this purpose. U.S. Pat. No. 3,773,577 suggests the addition of ethylene glycol in an amount of 0.5% by weight per volume of the etching solution but with no explanation of its purpose in the solution.

U.S. Pat. No. 4,437,931 describes the use of an acetylenic diol as a promoter in a peroxide etching bath containing free $Cl^-$ or $Br^-$ ions. Examples of suitable polymers include 2 butyne-1, 4-diol, 3-hexyne-2, 5 diol and others.

The copper that is removed from the printed circuit board forms copper sulfate which remains dissolved in the etch bath. As the concentration of the copper sulfate in the etch bath increases, its presence tends to retard the etching rate of the bath. To restore the efficiency of the bath, the copper sulfate is removed and the sulfuric acid and peroxide are replenished. A simple method or removing the copper sulfate is to chill the bath thereby reducing the solubility of the copper sulfate causing it to crystallize and precipitate out as a solid. One way of chilling the bath is to transfer the bath from the treatment tank to an auxiliary tank where refrigeration equipment is used to cool the solution from its operating temperature of 75° F.(24° C.)–140° F.(60° C.) to 32° F.(0° C.)–50° F.(10° C.). At 60° C. the solubility of copper sulfate is 40 gms per 100 ml of water whereas at 10° C., the solubility is about 17.4 gm/100 ml of water, and at 0° C., the solubility of $CuSO_4$ is about ⅓ of its solubility at 60° C. A problem arises, however, during the chilling of the solution because the copper sulfate as it crystallizes tends to deposit on the sides of the tank and the crystal growth proceeds uninhibited until a hard layer of copper sulfate crystals is firmly deposited on the equipment. Often, it must be removed from the equipment with chisels, pneumatic hammers or the like. Furthermore, the loose crystals that form on the bottom of the tank become too large to be removed by filtering.

The unrestrained crystal growth is often enhanced by the presence of the stabilizers in the etch bath.

BRIEF DESCRIPTION OF THE INVENTION

This invention relates to a method of etching copper in the preplate and pattern plate steps in the production of printed circuit boards. More particularly, it relates to the use of a small amount of an organic additive selected from the groups consisting of a low molecular weight glycol having the formula $HOCH_2(CH_2)\ \chi\ CH_2OH$ wherein $\chi$ is either 0 or 1, and gum arabic (acacia gum). The additive serves as a crystallization control agent. The two glycols represented by this formula are ethylene glycol and propylene glycol.

The organic additive is present in the operating bath in an amount sufficient to control the size of the copper sulfate crystals that are formed in the bath, preferably from about 0.02% to about 0.2%. The bath can handle substantially greater amounts of ethylene glycol as indicated in U.S. Pat. No. 3,773,557. When used within the preferred range, the glycol serves to keep the crystals of $CuSO_4$ in discrete particulate form, preventing the growth of the particles and their adhesion to the equipment. The crystals can be readily removed from the etch bath by filtration. Furthermore, the crystals of $CuSO_4$ that are formed are sufficiently pure that they can be used as a source of copper for the electroless or electrolytic plating.

DETAILED DESCRIPTION OF THE INVENTION

The production of multilayer printed circuit boards involves many discrete steps, nearly all of which are important in producing an end product which performs in a totally satisfactory, failsafe manner. A typical board construction comprises a laminate of copper foil sandwiched between layers of epoxy resin. The board is drilled to form holes which are metallized with copper to provide electrical contact between the two surfaces of the board. Both prior to and following the electroless and/or electrolytic plating of copper, the need arises to etch a certain amount of copper from laminate. The board is subject to a so-called pre-plate etch to provide a clean surface which can be suitably activated for the deposit of electroless copper. Following plating, a photo resist or screen resist is applied, exposed and developed to form a circuit pattern. Again the board is etched to remove the copper from the exposed portions thereof as one step in developing the circuitry through the laminate.

An etch solution is typically prepared by mixing together the following components:

| | |
|---|---|
| $H_2SO_4$ - 66° Be | 10% |
| Water | 86%–88% |
| Micro-etch concentrate | 2%–4% |

This concentrate is prepared by blending together the following components:

| | |
|---|---|
| $H_2O_2$ (50%) | 90%–95% |
| Peroxide stabilizers | 1%–5% |
| Crystallization control agent | 1%–5% |

The crystallization control agent is preferably heated to an elevated temperature at which the stabilizers can be dissolved, and the stabilizers are added with mixing. The mixture is then cooled down to room temperature and the peroxide is blended in to give the concentrate.

The peroxide stabilizer or mixture of stabilizers are selected from the group of compounds that traditionally are used for the specific purpose of chemically or physically retarding the decomposition of the peroxide. A number of these were described in the aforementioned patents and include the following:

- Lower saturated aliphatic alcohols such as methanol, ethanol, propanol and butanol;
- phosphoric acid; protein;
- arylsulfonic acids - e.g. phenol sulfonic acid and sulfo salicylic acid, toluene sulfonic acid;

Etch rate improvers, promoters or catalysts may be added to the bath and typically would include:

- metallic ions of silver, mercury, palladium, gold and platinum;
- phenacetin, sulfathiazole or silver ions alone or with dibasic acids, phenyl ureas, benzoic acids, urea or thiourea;
- camphor; acetophenone; quinones;
- acetylenic diols; and organic acids such as propionic acid, acetic acid, butyric acid.

The concentration of the peroxide, stabilizers and control agent in the bath, based on a usage in the amount of 2% to 4% covers the following range:

| | |
|---|---|
| $H_2O_2$ | .9% to 1.9% |
| Stabilizers | 0.02% to 0.2% |
| Crystallization control agent | 0.02% to 0.2% |

For use in the pre-plate etching of the board, the micro-etch concentrate is used in an amount of 3–4% to produce a bath which, when operated at a temperature of 110°–120° F. (43°–49° C.) is capable of achieving an etch rate of about 70 micro-inches per minute. When used as a pattern-plate etch, the concentrate is used at a level of 2–3% at a lower temperature of 75°–85° F. (24°–29° C.) to give an etch rate of about 6 micro-inches.

In either application, the solution can be loaded up to about 1 square foot of treatable surface area per gallon of etchant. The solution preferably is agitated mechanically or the board is moved or slowly oscillated in the bath to improve the thru-hole etching capability of the solution.

As the etch solution is used, the concentration of copper sulfate dissolved in the solution builds up, gradually approaching saturation. This is best determined by analyzing for copper sulfate and comparing the concentrations with the saturation point for copper sulfate at the bath operating temperature. Less accurate means may also be used such as colormetric procedures to measure the increase in color intensity of the etch bath in proportion to the build-up of dissolved copper sulfate. Yet another method is to plot the decrease in the micro-etch rate as a function of copper sulfate build-up. As the concentration approaches saturation, etching is interrupted and the etch bath is treated to crystallize and remove a substantial amount of copper sulfate. The treatment consists of removing the solution from the etch tank, preferably by pumping it into an auxiliary tank equipped with a cooling coil to lower the temperature of the solution to a temperature of between 35° and 50° F. (2° to 10° C.), preferably between 40° and 45° F. (4° to 7° C.). Alternatively, the crystallization can be carried out in the etch tank by shutting down the etching operation, cooling the solution, and removing crystals after formation. Because the etching of copper with the peroxide is an exothermic reaction, the etch tank normally is equipped with auxiliary cooling coils to maintain the bath at a constant temperature. Thus, the means for cooling of the bath are already present.

In any event, after the crystals of $CuSO_4$ have been removed from the bath, it is adjusted as needed to replenish the $H_2SO_4$ and peroxide levels before re-use. The copper sulfate crystals are sufficiently pure to permit them to be used as a source of copper for the preparation of the electroless and/or electrolytic copper plating solutions. Typically, between 50%–75% of the copper sulfate is crystallized out and removed from solution during each treatment, depending on the temperature to which the bath is chilled, and the degree of saturation at the start of the treatment.

To more fully illustrate the invention, but without the intention of being limited thereby, the following example is presented.

EXAMPLE

A micro-etch bath is prepared with the following composition on a weight basis:

| | |
|---|---|
| Water | 86%–87% |
| Sulfuric acid - 66° Be | 10% |
| Micro-etch concentrate | 3%–4% |

The concentrate is composed of the following:

| | |
|---|---|
| $H_2O_2$ (50% solution) | 90% |
| Stabilizers - proprietary blend of sodium salicylate, phenol sulfonate, a fluorocarbon and a wetting agent | 5% |
| Ethylene glycol | 5% |

and is prepared by heating the ethylene glycol to 150° F.(65° C.), adding the proprietary blend of stabilizers with agitation and cooling down to room temperature before adding the hydrogen peroxide. The concentrate is then mixed with the dilute sulfuric acid immediately prior to use. The bath is heated to a temperature of 120° F. and a printed circuit board is placed in the bath. The bath is mechanically agitated or alternatively the board is moved in the bath to increase the amount of etchant going through the holes drilled in the board. The boards are retained in the bath for a time of ½ to 3 minutes to remove from 35–210 microinches of copper. Etching is continued until the bath contains 70–80 gms of copper per liter of bath after which the bath is pumped into an auxiliary tank where it is cooled to 40°–45° F. to crystallize out the copper sulfate. The presence of the minute amount of ethylene glycol appears to limit the amount of crystal growth which occurs, while at the same time preventing the crystals from adhering to the sides of the auxiliary tank.

It can be seen from the Example that the actual concentration of ethylene glycol in the etch bath is very low, approximating 0.15% to 0.20% by weight. As previously indicated, the amount of the glycol or the gum arabic in the micro-etch concentrate can be as low as 1%. Inasmuch as the amount of the concentrate present in the etch bath can range from 2% to 4%, the effective concentration of the crystallization control agent in the bath can be as low as 0.02% by weight.

Although the example described the inclusion of the crystallization control agent in the initial bath make-up, the invention can also be practiced by the addition of the gum arabic or the low-molecular weight glycol to the bath at an intermediate state or immediately prior to crystallization, insuring, of course, that the agent is uniformly dispersed throughout the bath before cooling.

These and other modifications can be made in the practice of the present invention without thereby departing from the scope thereof as delineated by the appended claims in which we claim:

What is claimed is:

1. In a method of removing copper sulfate from a copper etch bath operated at a temperature of between about 75° F. (23° C.) and 140° F. (60° C.) and composed of hydrogen peroxide and sulfuric acid comprising cooling the etch bath to crystallize out the copper sulfate, the improvement comprising including in the etch bath from between about 0.02% and about 0.2% of a crystallization control agent selected from the group consisting of gum arabic and a low molecular weight glycol having the formula $HOCH_2(CH_2)_XCH_2OH$ wherein X is an integer having a value between 0 and 1.

2. The method of claim 1 wherein the step of cooling the etch bath comprises transferring the etch bath from an etch tank to an auxiliary tank and cooling the etch bath in the auxiliary tank to a temperature of between about 35° F. (2° C.) and 50° F. (10° C.).

3. The method of claim 2 wherein the bath is cooled to a temperature of between about 40° F. (4° C.) and 45° F. (7° C.).

4. The method of claim 1 wherein the control agent is said low molecular weight glycol, and said low molecular weight glycol is ethylene glycol.

5. A method of regenerating an aqueous copper etch bath composed of $H_2SO_4$, $H_2O_2$, stabilizers for the $H_2O_2$, and a crystallization control agent said bath prepared by blending the stabilizers together with the control agent at an elevated temperature, cooling the blend and mixing the blend with $H_2O_2$ to give a concentrate, mixing the concentrate with $H_2SO_4$ to give a bath useful at temperatures in the range of 75° F. (23° C.) and 140° F. (60° C.), said process comprising cooling the bath to crystallize out copper sulfate formed during etching, and limiting the growth of copper sulfate during crystallization wherein $H_2SO_4$ and $H_2O_2$ are present at concentrations effective for etching copper, stabilizers are present at concentrations effective for stabilizing $H_2O_2$, and the crystallization control agent present at a sufficient concentration to maintain the copper sulfate crystals in discrete particulate form and is is selected from the group consisting of gum arabic and a low molecular weight glycol having the formula $HOCH_2(CH_2)_XCH_2OH$ wherein X is an integer having a value between 0 and 1.

6. The method of claim 5 wherein said control agent is present in the bath in an amount of between about 0.02% and about 0.2%.

7. The method of claim 6 wherein the bath is cooled to a temperature in the range of between about 35° F. (2° C.) and 50° F. (10° C.).

* * * * *